US010612837B2

(12) United States Patent
Fei et al.

(10) Patent No.: US 10,612,837 B2
(45) Date of Patent: Apr. 7, 2020

(54) AIRTIGHT BOX

(71) Applicant: QINGDAO HAIER JOINT STOCK CO., LTD., Qingdao, Shandong Province (CN)

(72) Inventors: Bin Fei, Qingdao (CN); Riyong Lu, Qingdao (CN); Jinlin Liu, Qingdao (CN); Xiaodong Zhou, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 4 days.

(21) Appl. No.: 15/781,146

(22) PCT Filed: Jun. 17, 2016

(86) PCT No.: PCT/CN2016/086171
§ 371 (c)(1),
(2) Date: Jun. 3, 2018

(87) PCT Pub. No.: WO2017/113635
PCT Pub. Date: Jul. 6, 2017

(65) Prior Publication Data

US 2018/0356148 A1 Dec. 13, 2018

(30) Foreign Application Priority Data

Dec. 29, 2015 (CN) ..... 2015 1 1023153

(51) Int. Cl.
*F25D 25/02* (2006.01)
*B65D 43/02* (2006.01)
*F25D 25/00* (2006.01)

(52) U.S. Cl.
CPC ..... *F25D 25/025* (2013.01); *B65D 43/0212* (2013.01); *F25D 25/005* (2013.01); *F25D 25/021* (2013.01); *B65D 2543/00953* (2013.01)

(58) Field of Classification Search
CPC ..... F25D 25/02; F25D 25/021; F25D 25/025; F25D 25/005; B65D 43/0212; E05B 65/46
(Continued)

(56) References Cited

U.S. PATENT DOCUMENTS

2003/0201700 A1 10/2003 Cho
2005/0145704 A1* 7/2005 Hwang ..... F25D 17/045 236/44 A
(Continued)

FOREIGN PATENT DOCUMENTS

CN 101021379 A 8/2007
CN 201653058 U 11/2010
(Continued)

*Primary Examiner* — James O Hansen
(74) *Attorney, Agent, or Firm* — Cheng-Ju Chiang

(57) ABSTRACT

There is provided an airtight box, comprising a box body and a cover covering the box body to close the box body tightly. The box body is provided with a receiving chamber with an opening which opens upwards and two side walls respectively located on both sides of the receiving chamber. A sliding groove extending longitudinally is provided on an outer side of each side wall. The airtight box is further provided with an opening and locking mechanism slidably connecting the cover and the box body. The opening and locking mechanism is provided with a pushing member slidably fixed in the sliding groove and a connecting rod rotatably fixed on the pushing member and mounted inside the cover. The connecting rod, under an action of the pushing member, presses upwards and drives the cover backwards to expose the receiving chamber to the outside.

9 Claims, 20 Drawing Sheets

(58) Field of Classification Search
USPC ..... 312/402, 404, 330.1
See application file for complete search history.

(56) References Cited

U.S. PATENT DOCUMENTS

| | | | | |
|---|---|---|---|---|
| 2007/0262686 | A1 | 11/2007 | Ji | |
| 2012/0126680 | A1* | 5/2012 | Lee | F25D 25/025 312/408 |
| 2013/0270986 | A1* | 10/2013 | Min | B65D 25/22 312/330.1 |
| 2015/0102717 | A1* | 4/2015 | Furr | F25D 25/025 312/404 |

FOREIGN PATENT DOCUMENTS

| | | | |
|---|---|---|---|
| CN | 102252485 | A | 11/2011 |
| CN | 102313434 | A | 1/2012 |
| CN | 102338543 | A | 2/2012 |
| CN | 202254609 | U | 5/2012 |
| CN | 102538363 | A | 7/2012 |
| CN | 203216203 | U | 9/2013 |
| CN | 203405053 | U | 1/2014 |
| CN | 103851871 | A | 6/2014 |
| CN | 105627682 | A | 6/2016 |
| DE | 202009015164 | U1 | 3/2010 |
| JP | 2009-36430 | A | 2/2009 |
| WO | 2012/062877 | A2 | 5/2012 |

* cited by examiner

AIRTIGHT BOX

CROSS REFERENCE TO RELATED APPLICATIONS

The present application is a 35 U.S.C. § 371 National Phase conversion of International (PCT) Patent Application No. PCT/CN2016/086171, filed on Jun. 17, 2016, which further claims benefit of Chinese Patent Application No. 201511023153.9, filed on Dec. 29, 2015, the disclosure of which is incorporated by reference herein. The PCT International Patent Application was filed and published in Chinese.

TECHNICAL FIELD

The present invention is related to an airtight box, and more particularly to an airtight box having an opening and locking mechanism.

BACKGROUND

At present, there are two problems in the practical application of airtight boxes in the market: the inconvenience and noise. The first problem lies in that the opening and locking process cannot be completed by a single action. According to the opening and locking process of an existing airtight box in the market, when opening the airtight box, the first action is to release the locking device by rolling or using downward buttons, and the second action is to completely open the airtight box to fetch articles by pulling, pushing or lifting the same. The locking process is similar. First, the drawer or the lid is closed by pulling, pushing or closing downward. Then, the locking device is locked by rolling or using the downward buttons. The second problem is the noise. As an action of releasing the locking device by rolling or using the downward buttons is used in the opening process, noise will be generated between the airtight box itself and the device fixing the airtight box. Both problems bring bad experience to users. At the same time, a rolling mechanism requires a rolling space to make way, which will cause losses to the effective volume of the drawer.

Therefore, it is necessary to design an improved airtight box to solve the above problems.

SUMMARY

The object of the present invention is to provide an airtight box that can be opened simultaneously when being pulled out.

To realize the above object, the present invention employs the following technical solutions. There is provided an airtight box, comprising a box body and a cover covering the box body to close the box body tightly, wherein the box body is provided with a receiving chamber with an opening which opens upwards and two side walls respectively located on both sides of the receiving chamber, a sliding groove extending longitudinally is provided on an outer side of each side wall, the airtight box is further provided with an opening and locking mechanism slidably connecting the cover and the box body, the opening and locking mechanism is provided with a pushing member slidably fixed in the sliding groove and a connecting rod rotatably fixed on the pushing member and mounted inside the cover, and the connecting rod, under an action of the pushing member, presses upwards and drives the cover backwards to expose the receiving chamber to the outside.

As an improved technical solution of the present invention, the pushing member is provided with a main body located above one end of the box body and two hanging walls extending downwards from both ends of the main body respectively, wherein the main body is provided with a pushing hand portion protruding upwards, and the pushing hand portion passes through the cover upwards and is exposed to the outside.

As a further improved technical solution of the present invention, the connecting rod is provided with a supporting rod received inside the cover and two ear rods vertically extending from both ends of the supporting rod respectively, wherein each ear rod is mounted on the hanging wall, and when the pushing member moves backwards, the hanging walls pushes the ear rods backwards and the ear rods drive the supporting rod upwards to support the cover upwards.

As a yet further improved technical solution of the present invention, each hanging wall is provided with an inverted L-shaped guide rail groove and a position limiting groove, wherein the position limiting groove vertically extends and passes through the hanging wall, and the guide rail groove longitudinally extends and passes through the hanging wall.

As a yet further improved technical solution of the present invention, the top of the position limiting groove communicates with the front end of the guide rail groove.

As a yet further improved technical solution of the present invention, the opening and locking mechanism further comprises a sliding member capable of sliding in the sliding groove longitudinally, wherein the sliding member is provided with a first pulley mounted in the position limiting groove and a second pulley mounted in the guide rail groove, and the second pulley is capable of rotating counterclockwise around the first pulley.

As a yet further improved technical solution of the present invention, the first pulley is provided with a front orienteering roller capable of sliding in the sliding groove, a fixed wheel located at an outer side of the front orienteering roller, and a first shaft passing through the axes of the front orienteering roller and of the fixed wheel, wherein an intermediate space is provided between the front orienteering roller and the fixed wheel to form a clamping portion.

As a yet further improved technical solution of the present invention, the second pulley is provided with a driven roller and a shaft cavity passing through the driven roller, wherein an edge of the driven roller is clamped within the clamping portion, and a tail end of the ear rod is received within the shaft cavity.

As a yet further improved technical solution of the present invention, the cover is provided with a box cover and a top cover mounted on the box cover, wherein a position limiting space is provided between the top cover and the box cover to allow the supporting rod to move upwards or downwards.

As a yet further improved technical solution of the present invention, a side of the box cover facing the top cover is provided with several fixing columns protruding upwards and arranged longitudinally to longitudinally limit the supporting rod in the position limiting space.

Compared with the prior arts, in the airtight box of the present invention, an opening and locking mechanism is provided between the cover and the box body, the opening and locking mechanism comprises a pushing member slidably fixed on the box body and a connecting rod rotatably fixed on the pushing member and mounted inside the cover, and the connecting rod rotates under the action of the pushing member and drives the cover upwards and backwards to leave the box body so as to open the airtight box. In this way, the airtight box of the present invention can be pulled out and opened by a single backward pushing action. In addition, if the airtight box of the present invention is used as a drawer of a refrigerator, the drawer can be opened without rolling the cover, thereby saving the rolling space required for rolling the cover and guaranteeing the effective volume of the drawer.

DETAILED DESCRIPTION

Figure 1:
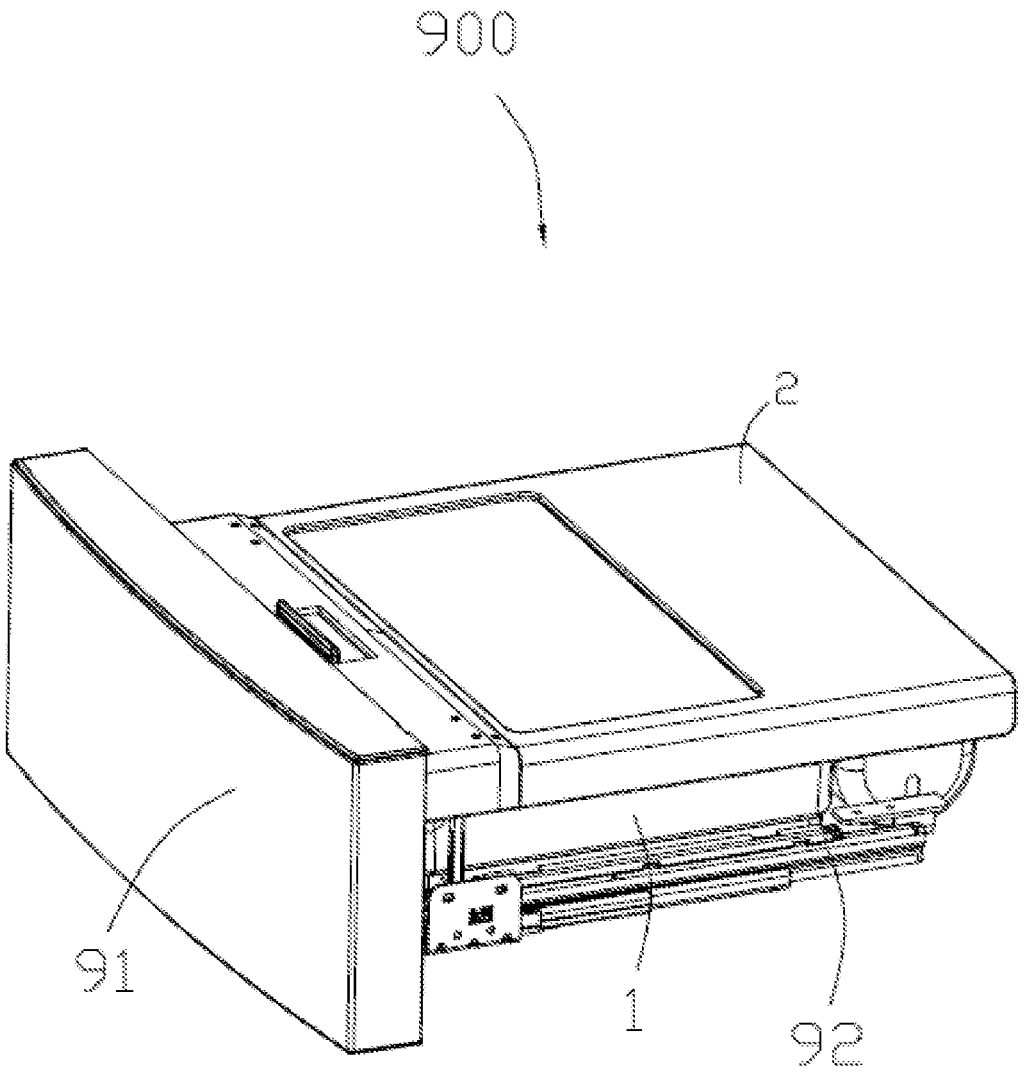
FIG. 1 is a schematic view of a refrigerator drawer of the present invention.
Figure 2:
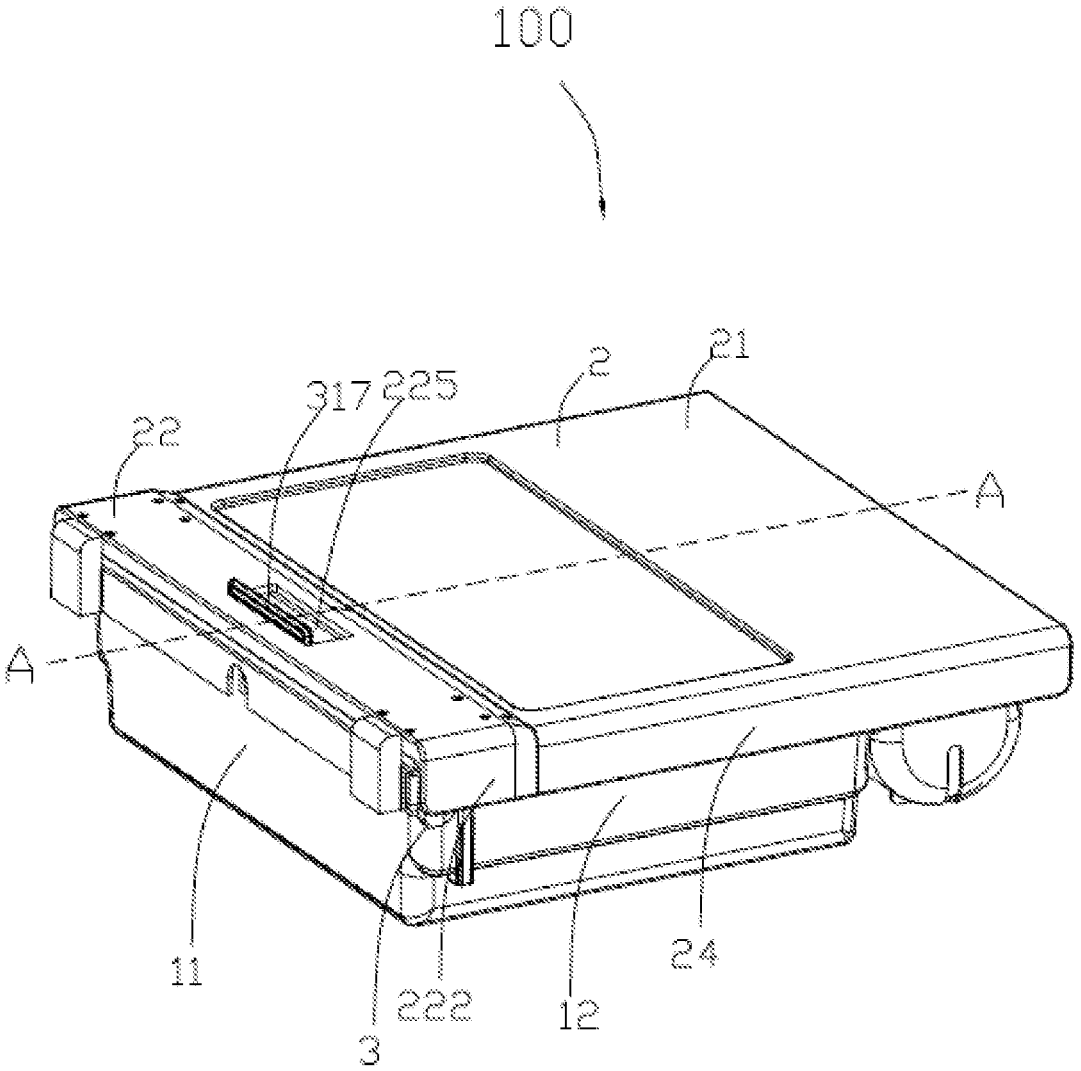
FIG. 2 is a schematic view of an airtight box assembly of a first embodiment of the present invention.

Referring to FIGS. 1 and 2, the present invention discloses a refrigerator drawer 900 provided with a door panel 91, a box body 1, a fixing shaft (not marked with a reference numeral) fixing the door panel 91 and the box body 1 together, and sliding rails 92 mounted on both sides of the bottom of the box body 1 respectively. The sliding rails 92 are used to allow the box body 1 to slide forwards or backwards relative to an inner tank (not shown) of the refrigerator.

The refrigerator drawer 900 is further provided with a cover 2, which covers the box body 1 to make the box body 1 into an airtight box 100, and a sealing ring 4 between the box body 1 and the cover 2. The present invention will describe the airtight box 100 in detail.

Referring to FIGS. 2-9, in a first embodiment of the airtight box 100 of the present invention, the airtight box 100 comprises a receiving chamber 10 with an opening which opens upwards, a front wall 11 located at the rear side of the door panel 91 of the refrigerator drawer 900 and the front side of the receiving chamber 10, two side walls 12 respectively extending from both ends of the front wall 11 and located at both sides of the receiving chamber 10, a rear wall 13 located at the rear side of the receiving chamber 10, and a bottom wall 14 located at the bottom of the receiving chamber 10. The box body 1 further comprises two receiving portions 111 located at the front side of the top of the front wall 11 and protruding forwards, and the receiving portion 111 is a receiving chamber with an opening which opens backwards. At a lateral side of the top of each side wall 12 is provided with a sliding groove 121 extending in a longitudinal direction of the refrigerator drawer 900. The two sliding grooves 121 provided on the two side walls 12 face each other in a symmetrical manner.

Referring to FIGS. 2-6, the cover 2 includes a box cover 21 mounted above the box body 1, and a top cover 22 fixed at the front end of the box cover 21. The box cover 21 is provided with a flat first main body 23 covering the receiving chamber 10, two first lateral panels 24 formed by folding from the two sides of the first main body 23 outwards and then downwards, and a fixing panel 25 formed by horizontally extending forwards from the forefront of the first main body 23. The two first lateral panels 24 are respectively located at outer sides of the two side walls 12 of the box body 1 to shield the sliding grooves 121. The fixing panel 25 includes a top surface 251, two parallel guiding grooves 252 formed by recessing from the top surface 251 and located at the front end of the fixing panel 25, and several fixing columns 253 respectively located at both sides of each guiding groove 252. The top surface 251 of the fixing panel 25 is lower than the top surface of the first main body 23. In this way, after the top cover 22 is fixed on the fixing panel 25, a space having a certain height is formed in the vertical direction between the top cover 22 and the fixing panel 25. At the inner sides of the two opposing first lateral panels 24 and at the rear side of the main body 23 are provided with rear orienteering rollers 26 fixed on the first lateral panels 24 respectively. When the cover 2 is mounted on the box body 1, the rear orienteering rollers 26 slide forwards or backwards in the two sliding grooves 121 of the box body 1 to drive the cover 2 to slide forwards or backwards relative to the box body 1.

The several fixing columns 253 at the two sides of each guiding groove 252 are divided into two groups in the longitudinal direction. The first group of the fixing columns 253 is provided at the front portion of the fixing panel 25, and includes two first fixing columns 253 symmetrically arranged at the two sides of the guiding groove 252 in the horizontal direction. The second group of the fixing columns 253 is provided at the rear portion of the fixing panel 25 close to the first main body 23, and includes two second fixing columns 253 symmetrically arranged at the two sides of the guiding groove 252, and one third fixing column 253 located at the outer side of the guiding groove 252 and at the rear side of one of the second fixing columns 253.

Figure 7:
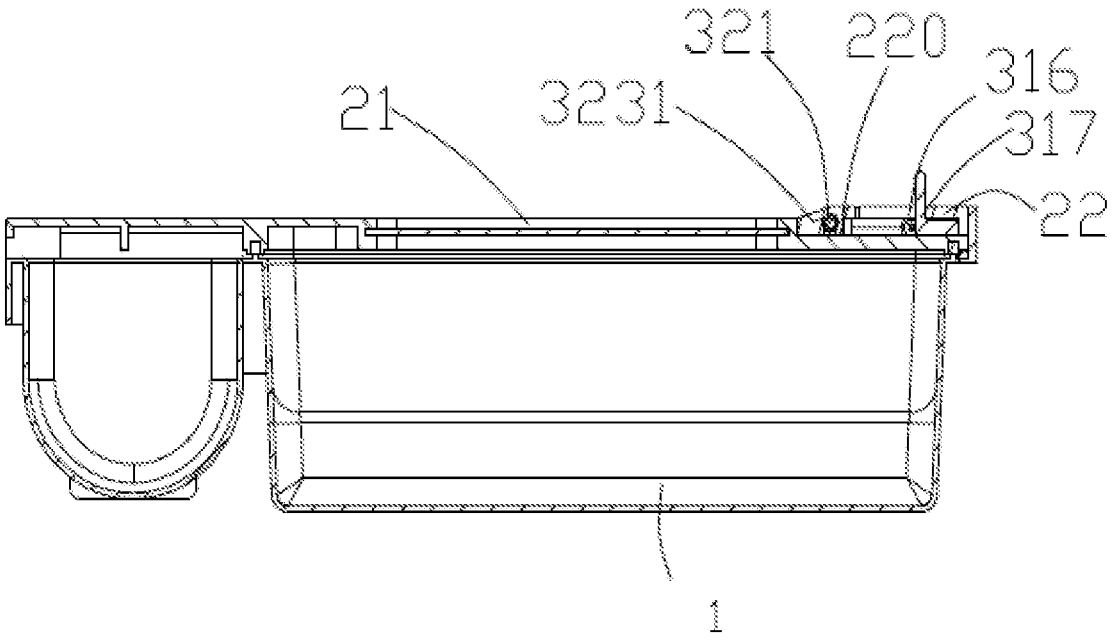
FIG. 7 is a section of an airtight box assembly of the first embodiment of the present invention along A-A of FIG. 2.
Figure 8:
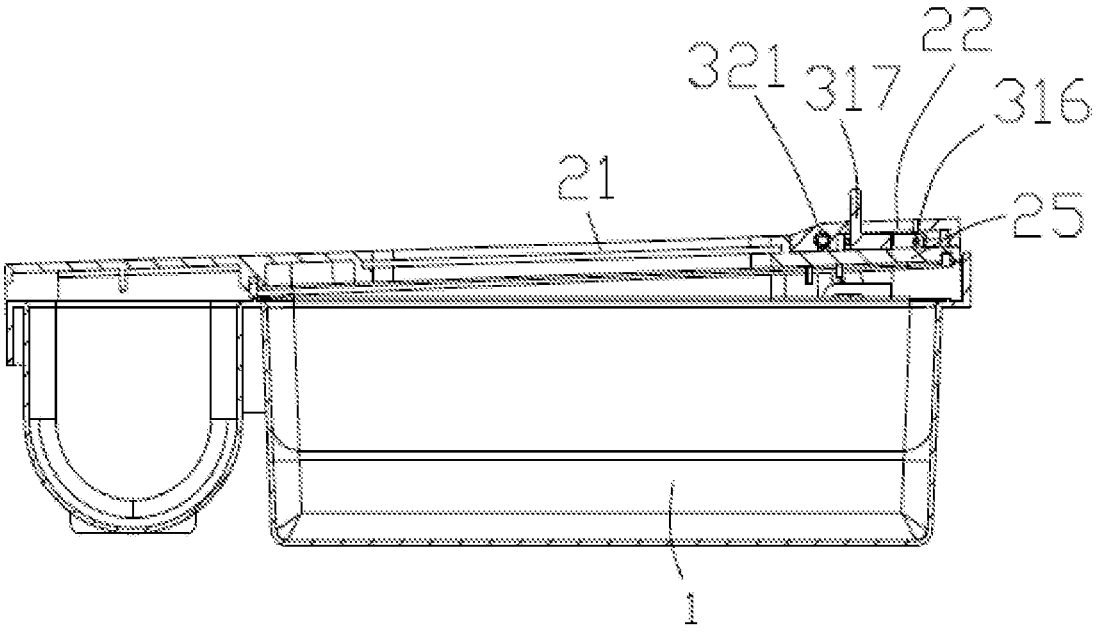
FIG. 8 is a section of an airtight box assembly of the first embodiment of the present invention with the front of the cover lifted.

The top cover 22 covers the fixing panel 25, and includes a flat second main body 221, second lateral panels 222 formed by folding from the two sides of the second main body 221 outwards and then downwards, and an extending wall 223 formed by extending backwards in a tilting manner from the rear end of the top cover 22. At the four corners of the second main body 221 corresponding to the fixing columns 253 of the first main body 23 are provided with vertical through holes 224, and vertical through give-way holes 225 are provided at the middle positions thereof. The top cover 22 passes through the through holes 224 through screws (not marked with reference numerals) and enters the fixing columns 253, so that the top cover 22 and the box cover 21 are fixed together. As shown in FIG. 7, a certain distance is reserved between the top surfaces of the top cover 22 and of the fixing panel 25. In this way, a give-way space (not marked with a reference numeral) is formed between the fixing panel 25 and the top cover 22, and forms a longitudinal position limiting space 220 between the second and third fixing columns 253.

Figure 3:
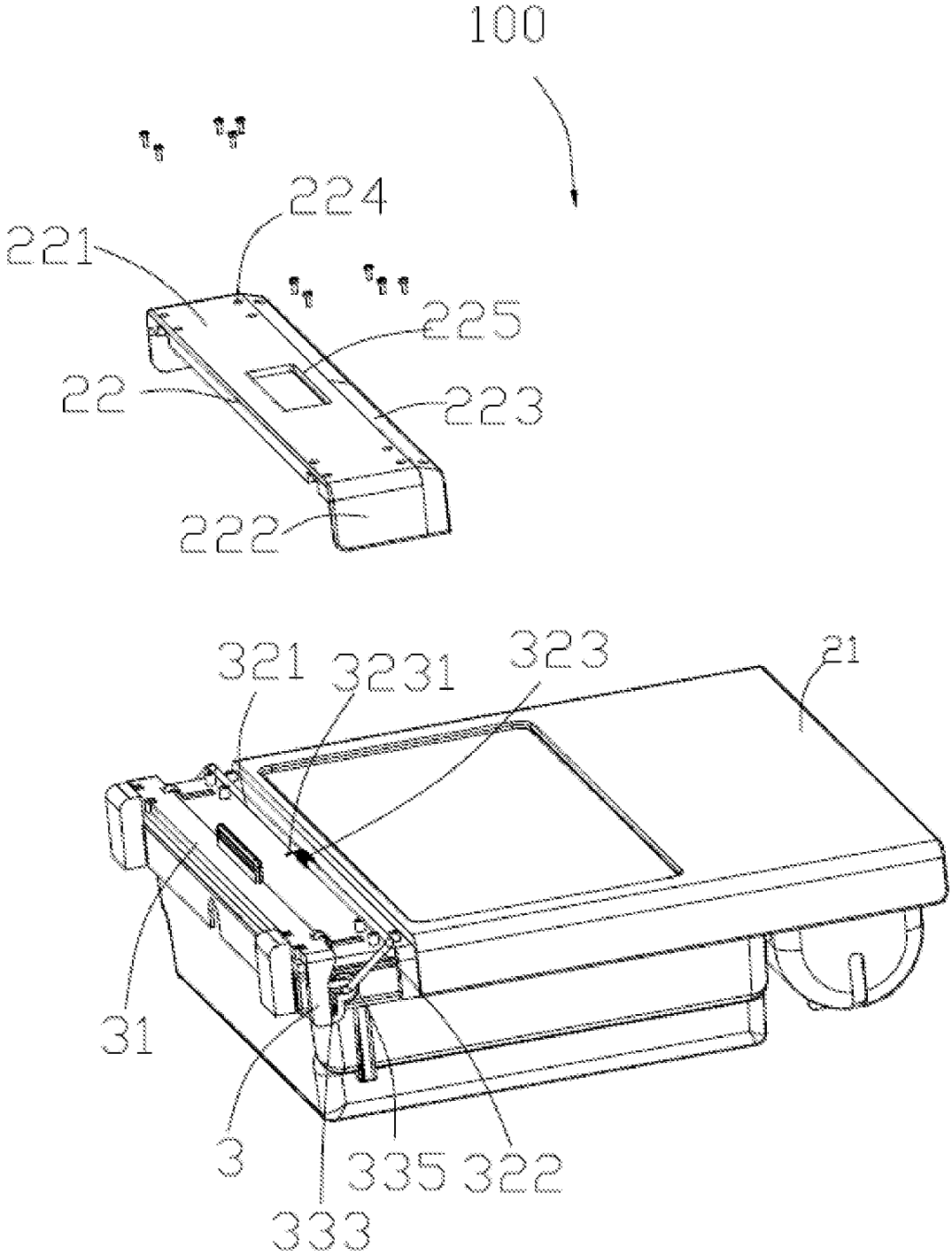
FIG. 3 is a partial decomposition schematic view of an airtight box assembly of the first embodiment of the present invention.
Figure 4:
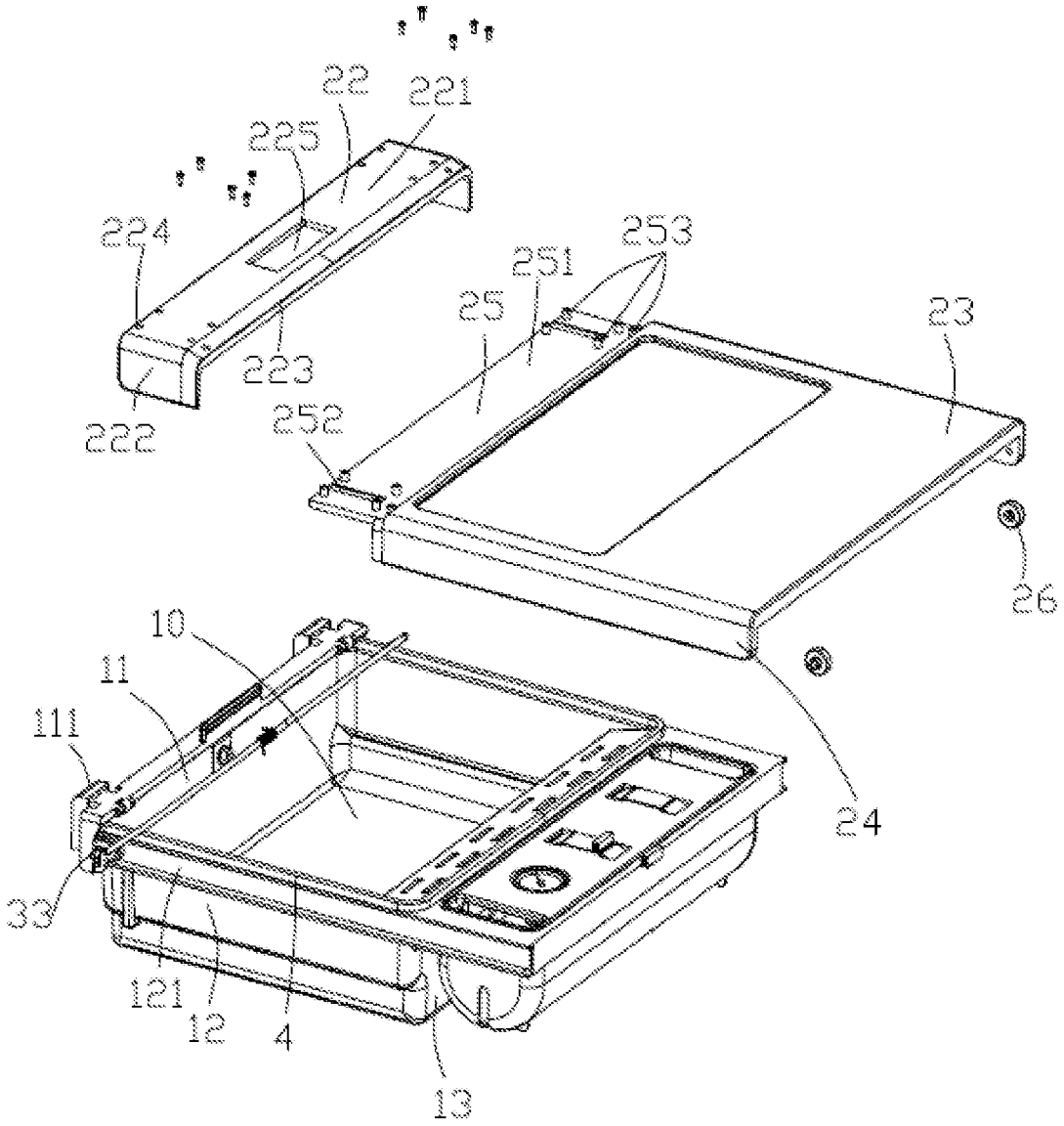
FIG. 4 is a further partial decomposition schematic view of an airtight box assembly of the first embodiment of the present invention.
Figure 5:
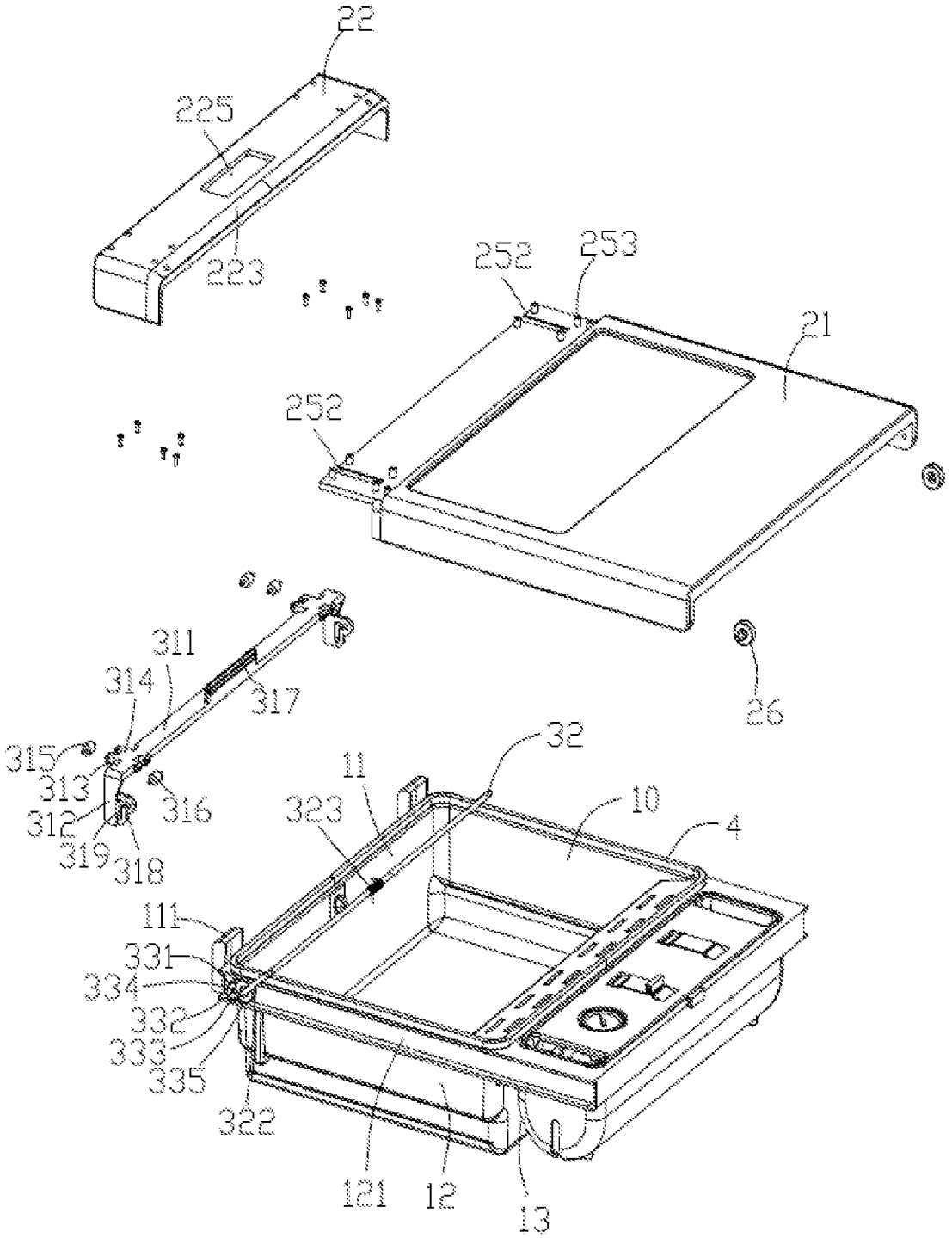
FIG. 5 is a further partial decomposition schematic view of an airtight box assembly of the first embodiment of the present invention.

Referring to FIGS. 3-5, the airtight box 100 further includes an opening and locking mechanism 3 mounted between the cover 2 and the box body 1. The opening and locking mechanism 3 includes a pushing member 31 slidably fixed in the sliding groove 121, a connecting rod 32 rotatably fixed on the pushing member 31, and a sliding member 33 which drives the pushing member 31 and in which the connecting rod 32 slides from a front end to a rear end in the sliding grooves 121.

The pushing member 31 is an integral pushing rod, and includes a main body 311 located above the fixing panel 25 of the cover 2, and two handing walls 312 respectively extending downwards from both ends of the main body 311 and respectively located at the outer sides of the two side walls 12 of the box body 1.

As shown in FIG. 5, several recesses 313 recessing backwards are provided at the edge of the front side of the main body 311 corresponding to the first fixing columns 253. Between two recesses 313, the main body 311 includes a protruding block 314 protruding forwards to extend into the receiving portion 111. A first rotary shaft 315 capable of rolling longitudinally along the guiding grooves 252 is mounted at the top end of the protruding block 314. A second rotary shaft 316 capable of rolling longitudinally along the guiding grooves 252 is mounted at the rear edge of the main body 311 corresponding to the protruding block 314. The lower halves of the first and second rotary shafts 315, 316 are received within the guiding grooves 252 respectively. At the rear edge of the main body 311 and between the two second rotary shafts 316 is provided with a pushing hand portion 317 protruding upwards from the top surface of the main body 311. The pushing hand portion 317 passes through the give-way hole 225 of the top cover 22 upwards and is exposed to the outside.

Each hanging wall 312 is provided with an inverted L-shaped guide rail groove 318, which horizontally passes through the hanging wall 312, and a position limiting groove 319. The guide rail groove 318 extends longitudinally and horizontally passes through the hanging wall 312. The position limiting groove 319 vertically extends and horizontally passes through the hanging wall 312. The top of the position limiting groove 319 communicates with the forefront of the guide rail groove 318.

Referring to FIG. 7, the connecting rod 32 is provided with a supporting rod 321 received inside the position limiting space 220 along the width direction of the box body 1, and two ear rods bent from the both ends of the supporting rod 321 respectively or vertically extending therefrom respectively. The tail end of each ear rod 322 is mounted on the hanging wall 312. The opening and locking mechanism 3 further includes a torsion spring 323 fitted over the supporting rod 321 and having two elastic arms 3231 which elastically press against the inner sides of the extending walls 223 of the top cover 2 respectively.

The sliding member 33 is provided with a first pulley (not marked with a reference numeral) mounted in the position limiting groove 319 and a second pulley (not marked with a reference numeral) mounted in the guide rail groove 318. The first pulley is provided with a front orienteering roller 331, a fixed wheel 332, and a first shaft 333 passing through the axes of the front orienteering roller 331 and of the fixed wheel 332. An intermediate space is provided between the front orienteering roller 331 and the fixed wheel 332 to form a clamping portion 334. The first shaft 333 passes the position limiting groove 319 outwards so that the front orienteering roller 331 can be clamped between the hanging wall 312 and the bottom wall of the sliding groove 121. The hanging wall 312 is located at an inner side of the second lateral panel 222.

The second pulley is provided with a driven roller 335 and a shaft cavity (not marked with a reference numeral) passing through the driven roller. An edge of the driven roller 335 is clamped within the clamping portion 334, and a tail end of the ear rod 322 of the connecting rod 32 passes through the guide rail groove 318 and is received within the shaft cavity of the driven roller 335. At this time, the supporting rod 321 of the connecting rod 32 can rotate about the axis of the shaft cavity. The front orienteering roller 331, the driven roller 335 and the fixed wheel 332 are sequentially arranged at the inner side of the hanging wall 312 from the inside out. The driven roller 335 can rotate counterclockwise about the front orienteering roller 331 with the first shaft 333 as the axis.

Figure 9:
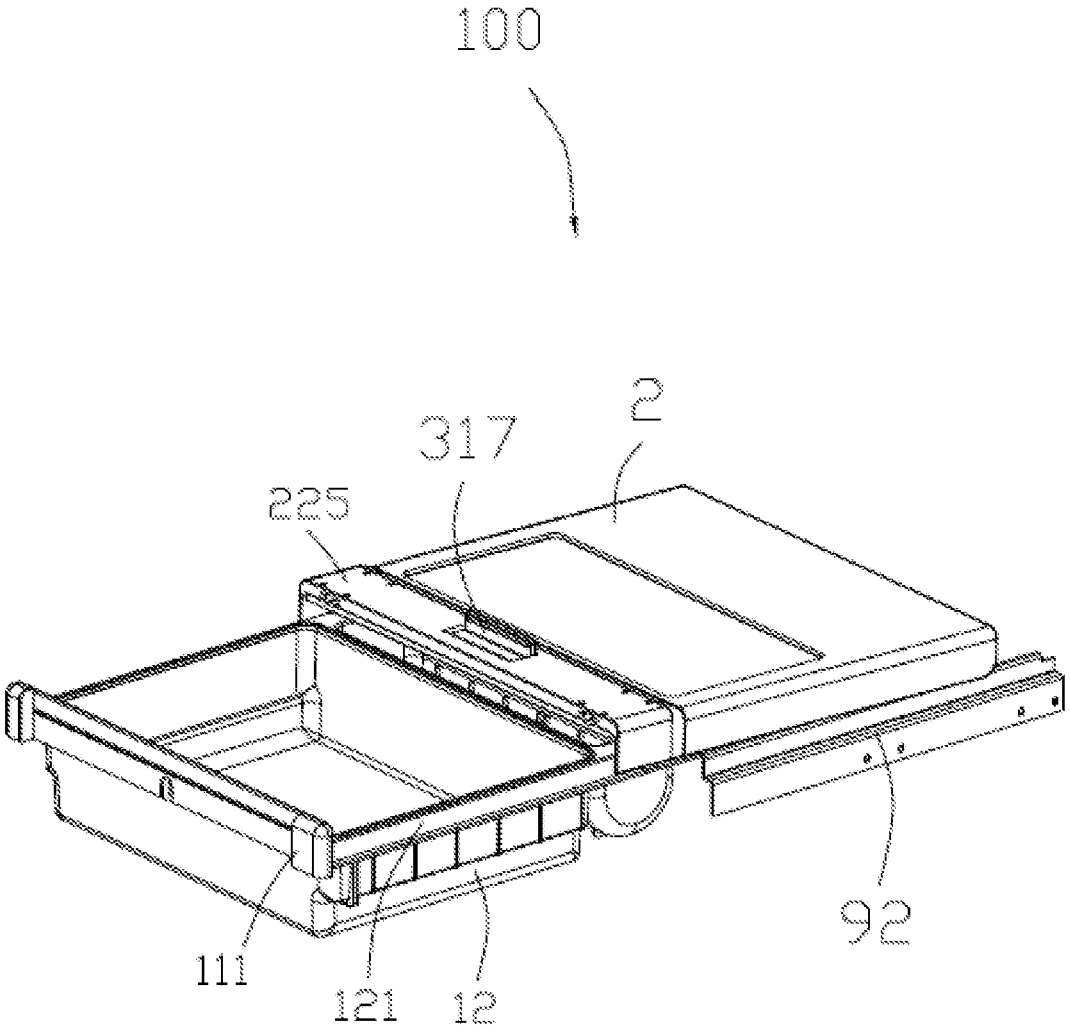
FIG. 9 is a schematic view of an airtight box assembly of the first embodiment of the present invention with the cover sliding to the rear of the airtight box.

Referring to FIG. 9, after the refrigerator drawer 900 of the present invention is pulled out of the inner tank of the refrigerator, when it needs to open the airtight box 100, the user pushes the exposed pushing hand portion 317 to force the first and second rotary shafts 315, 316 to roll backwards along the guiding grooves 252 of the cover 2, whereupon the main body 311 and the hanging walls 312 move forwards along the extending direction of the guide rail grooves 318 till the junction between the guide rail grooves 318 and the position limiting grooves 319. At this time, the supporting rod 321 of the connecting rod 32 slides upwards in the position limiting space 220 along the vertical direction to press the bottom surface of the second main body 221 of the top cover 22, and the ear rods 322 are switched from their original inclined backward state to a vertical state. Further, the first rotary shaft 315 and the protruding block 314 have slid backwards along the guiding grooves 252 and have exited from the receiving portion 111 of the box body; and when they continue pushing backwards and push the pushing hand portion 317, the guide rail grooves 318 corresponding to the ear rods 322 cannot move forward any more. At this time, the driven wheel 335 rotates counterclockwise relative to the front orienteering roller 331. The tail end of the ear rod 322 enters the position limiting groove 319. The fixed wheel 332 provides an upward supporting force to the driven roller 335, so that the ear rod 322 is driven to raise the supporting rod 321. The torsion spring 323 of the supporting rod 321 raises the cover 2 to separate the cover 2 from the box body 1, and continues pushing backwards and push the pushing hand portion 317. The cover 2 slides backwards in the sliding grooves 121 via the rear orienteering rollers 26, and is gradually separated from the box body 1, exposing the receiving chamber 10 in the air. The closing and locking operation steps are contrary to the above operations.

Figure 10:
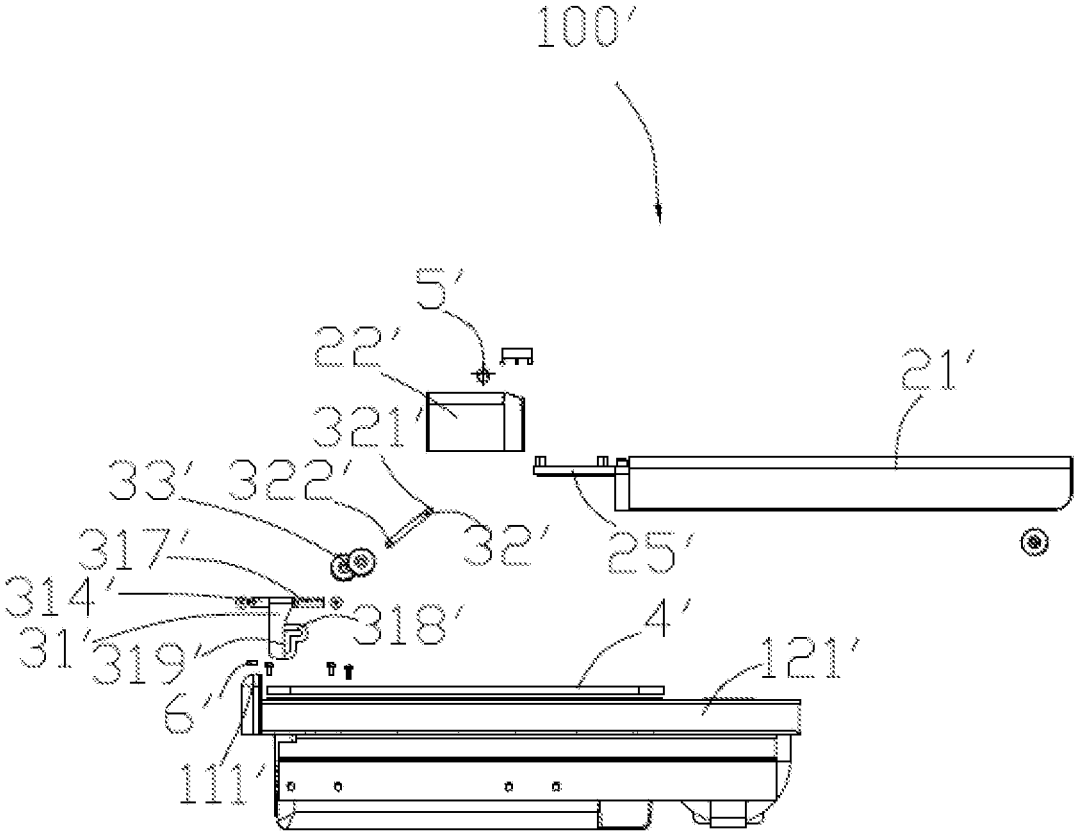
FIG. 10 is a schematic view of an airtight box assembly of a second embodiment of the present invention.

Referring to FIG. 10, in a second embodiment of the airtight box 100' of the present invention, the airtight box 100' has substantially the same structure as the airtight box 100 in the first embodiment does. The major difference lies in the opening and locking mechanism (not marked with a reference numeral). Other structures of the airtight box 100' will not be elaborated here, and only the opening and locking mechanism is described. The opening and locking mechanism includes a pushing member 31' slidably fixed in the sliding groove 121', a connecting rod 32' rotatably fixed on the pushing member 31', and a sliding member 33' which drives the pushing member 31' and in which the connecting rod 32' slides from a front end to a rear end in the sliding grooves 121'.

Figure 6:
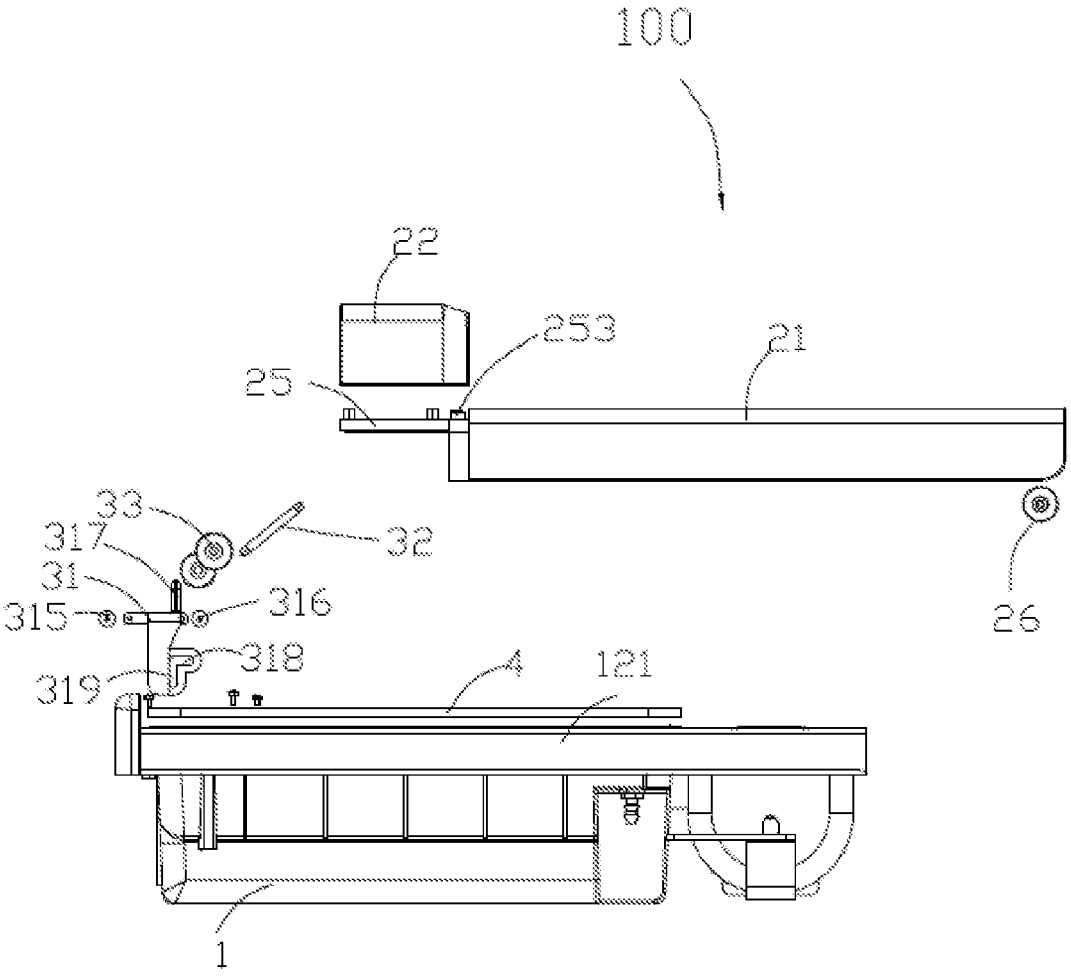
FIG. 6 is a decomposition schematic view of an airtight box assembly of the first embodiment of the present invention.

Referring to FIGS. 6 and 10, the connecting rod 32' and the sliding member 33' of the airtight box 100' of the second embodiment shown in FIG. 10 have the same structures as those of the airtight box 100 of the first embodiment shown in FIG. 6 do. The difference is that the opening and locking mechanism of the airtight box 100' of the second embodiment further includes an electrically driven structure 5' provided on the top cover 2', and a switch button 6' electrically connected to the electrically driven structure 5'; the pushing member 31' is not provided with a pushing hand portion; instead, at the rear edge of the main body 311' of the pushing member 31' is provided with a rack 317' fixed with the main body 311' and meshed with the electrically driven structure 5'. The electrically driven structure 5' may be built with an electronic control program or may be electrically connected with an electronic control program built in the airtight box 100'. When it needs to open the airtight box 100', the switch button 6' is pressed. Then, the electrically driven structure 5' powers on and drives the rack 317' to move backwards, thereby driving the pushing member 31' to slide backwards. According to the preset electronic control program, the tail end of the ear rod 322' of the connecting rod 32' travels the whole inverted L-shaped guide rail groove 318' and the position limiting groove 319'. At this time, the cover 2 is raised by the supporting rod 321' of the connecting rod 32'. The airtight box 100' is in a relaxed state. By slightly pushing the cover 2', the airtight box 100' can be opened. On the other hand, when it needs to lock the airtight box 100', the switch button 6' is pressed. Then, the electrically driven structure 5' drives the rack 317' to move forwards. According to the preset electronic control program, the L-shaped distance is covered, so that the supporting rod 321 rotates and releases the cover 2, thereby locking the airtight box 100'.

To sum up, in the airtight box 100' of the second embodiment of the present invention, which is based on the first embodiment, by substituting the movement manner of the pushing member 31 of sliding forwards under manual driving with a movement manner of sliding forwards under electrical driving using the electrically driven structure 5', the airtight box 100' realizes automatic opening and closing, thereby facilitating its use.

Referring to FIGS. 11-21 and with reference to FIG. 1, the refrigerator drawer 900 of the present invention may further include partitioning panels 7, 7' and 8 fixed on the inner tank of the refrigerator and between the box body 1 of the airtight box in the first embodiment and the inner tank of the refrigerator. The partitioning panels 7, 7', 8 and the airtight box 100 together form an airtight box assembly 200 in the first embodiment, an airtight box assembly 200' in the second embodiment, and an airtight box assembly 300 in the third embodiment, respectively.

Figure 11:
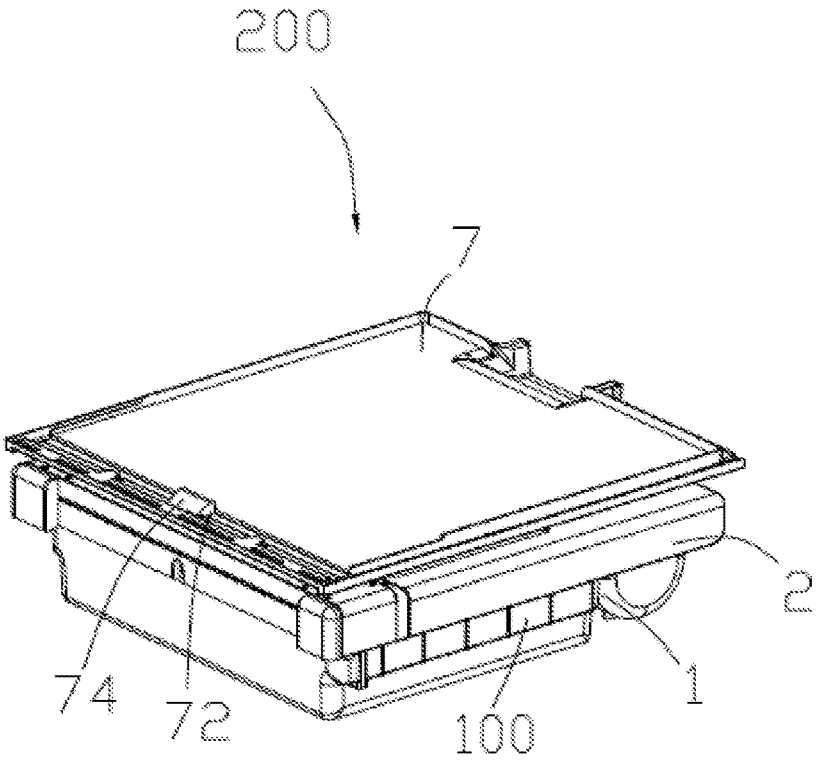
FIG. 11 is a schematic view of an airtight box including partitioning panels fixed on the inner tank of the refrigerator and between the box body, based on the airtight box assembly of the first embodiment.
Figure 12:
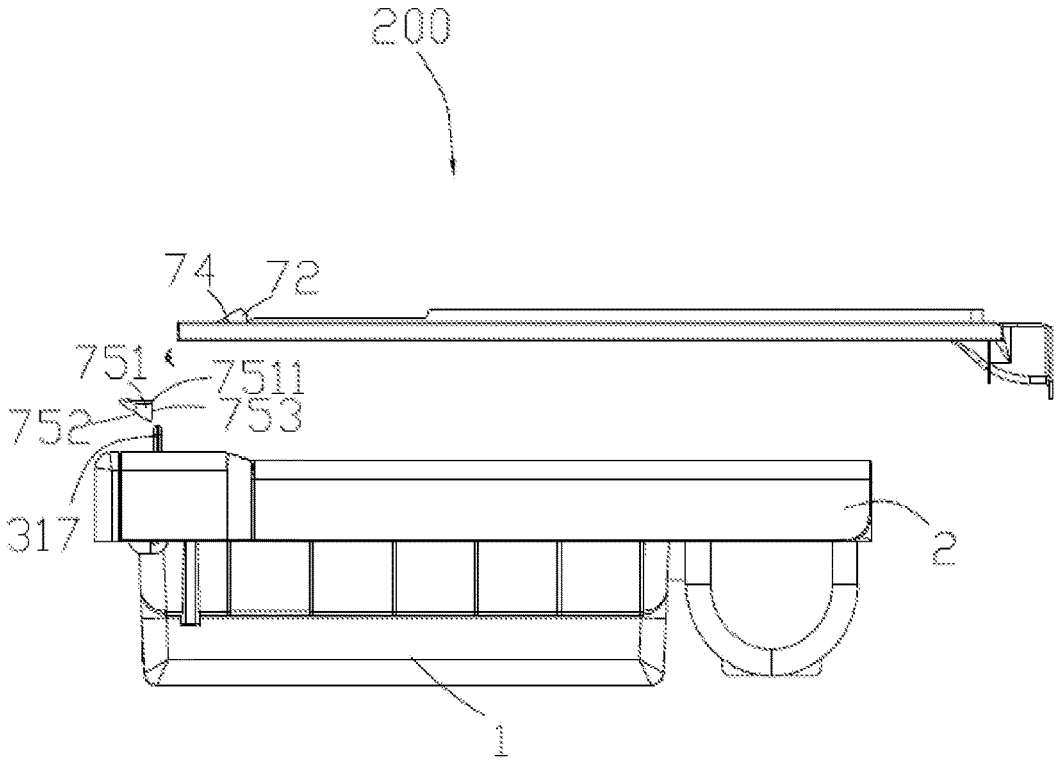
FIG. 12 is a partial decomposition schematic view of an airtight box assembly of the first embodiment of the present invention.
Figure 13:
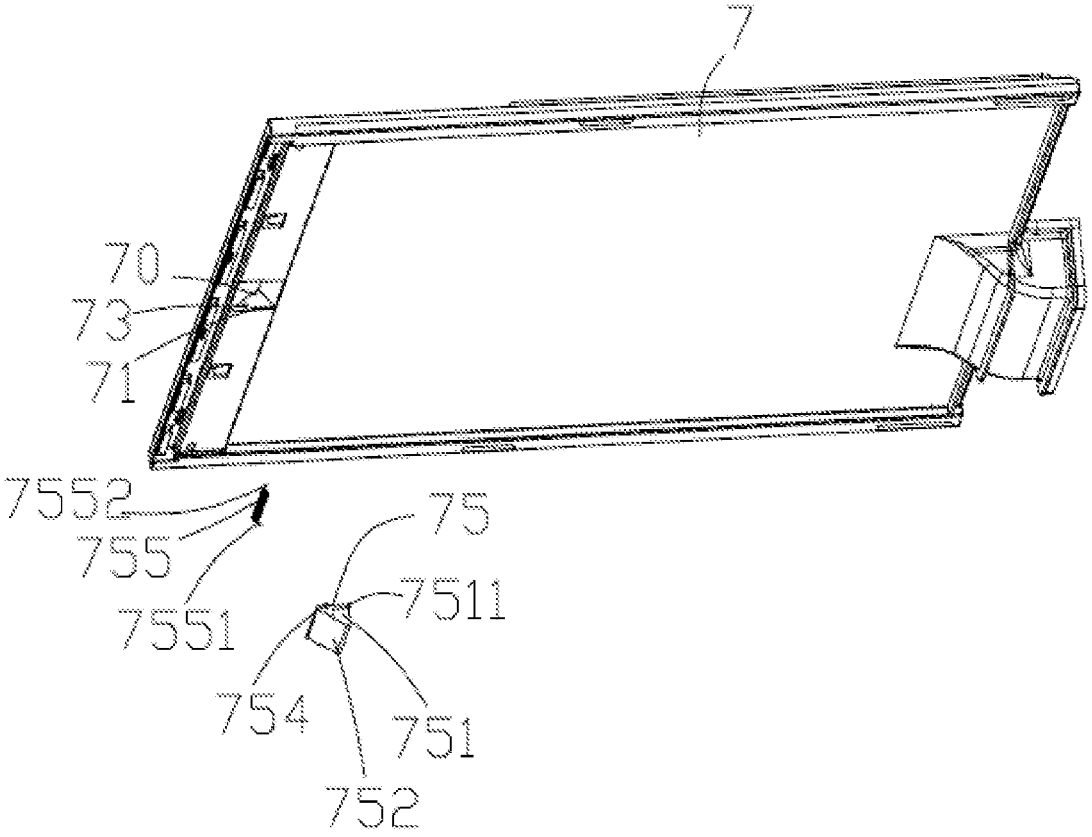
FIG. 13 is a decomposition schematic view of partitioning panels and stopping member of an airtight box assembly of the first embodiment of the present invention.
Figure 14:
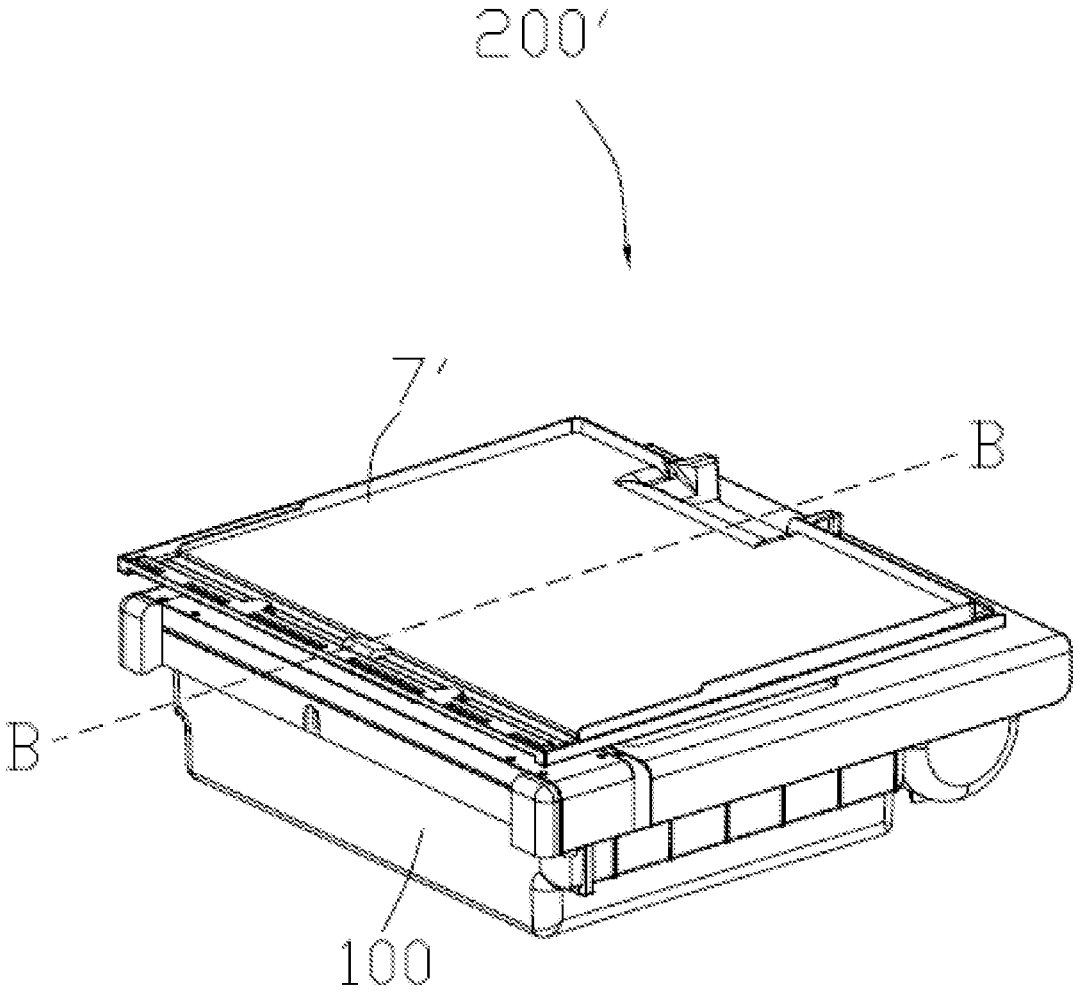
FIG. 14 is a schematic view of an airtight box assembly of the second embodiment of the present invention.
Figure 15:
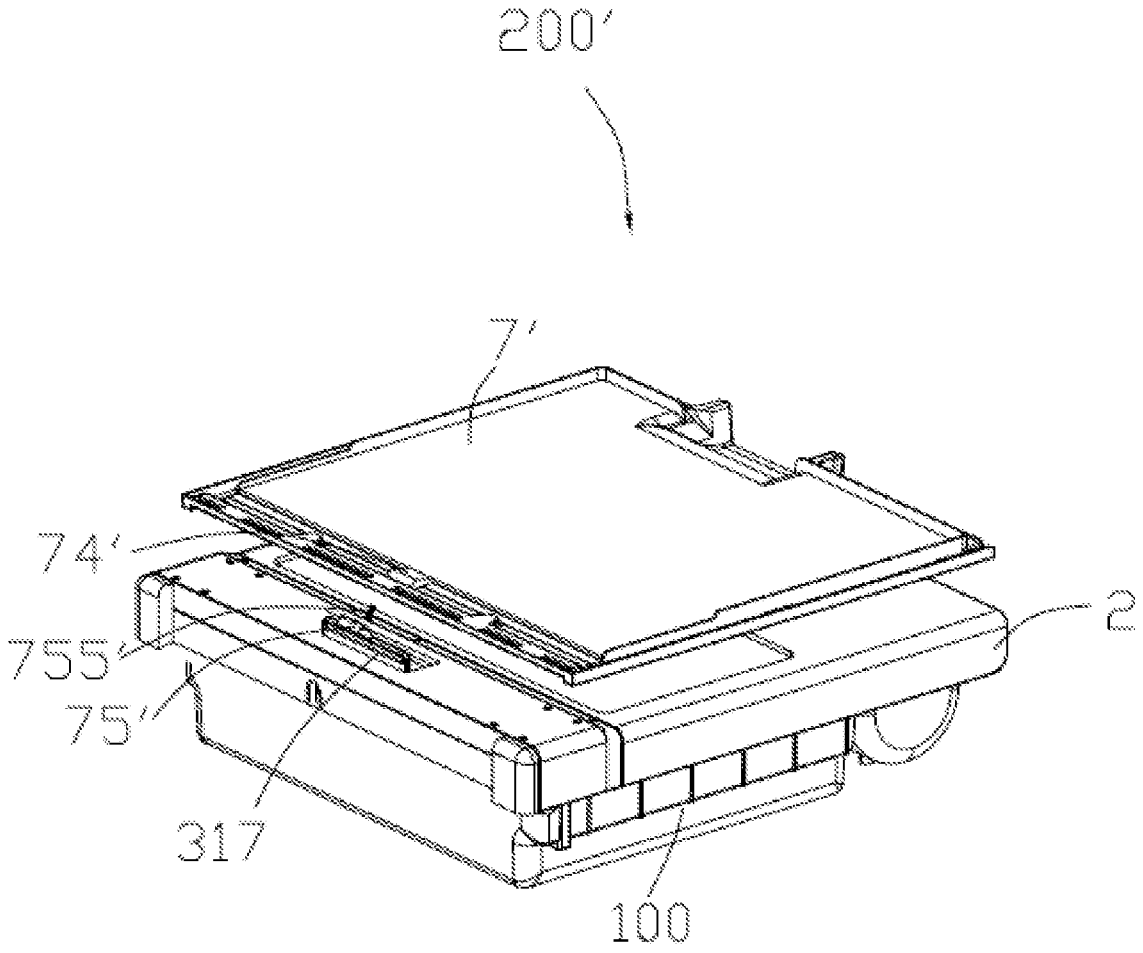
FIG. 15 is a partial decomposition schematic view of an airtight box assembly of the second embodiment of the present invention.
Figure 16:
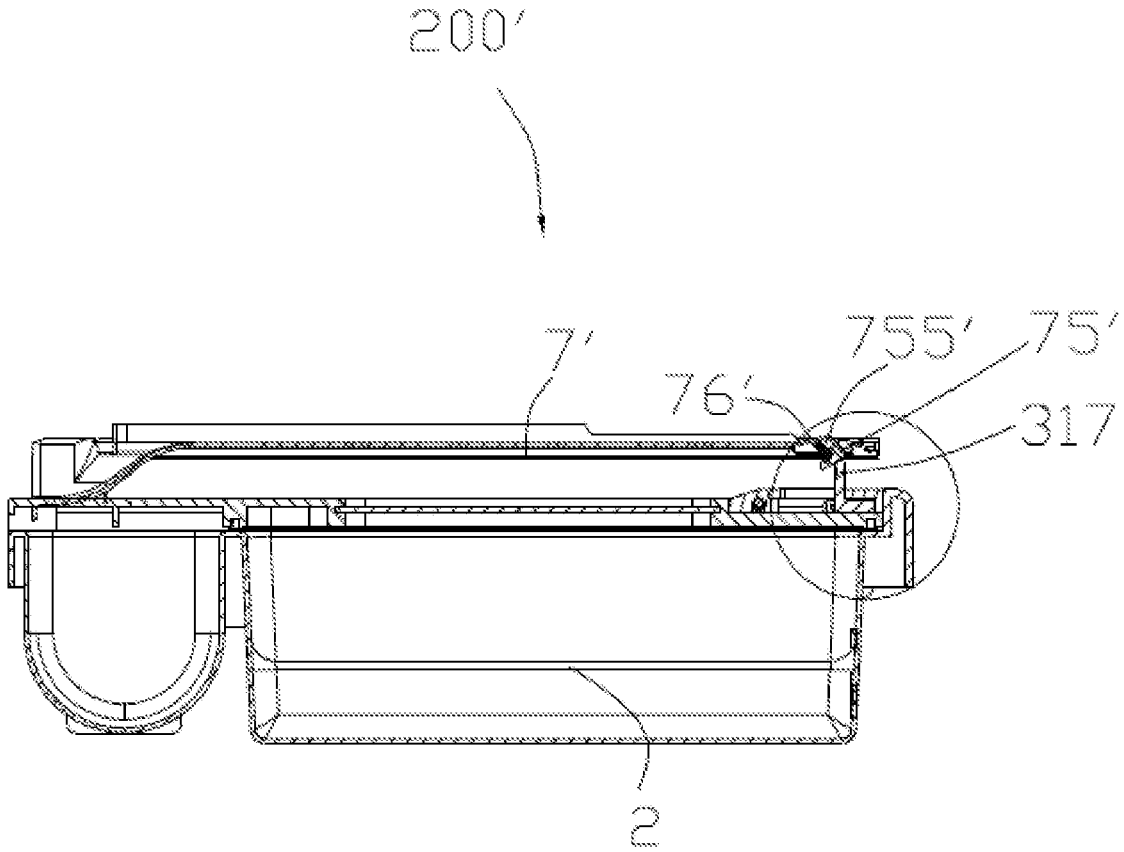
FIG. 16 is a section of an airtight box assembly along B-B of FIG. 14.
Figure 17:
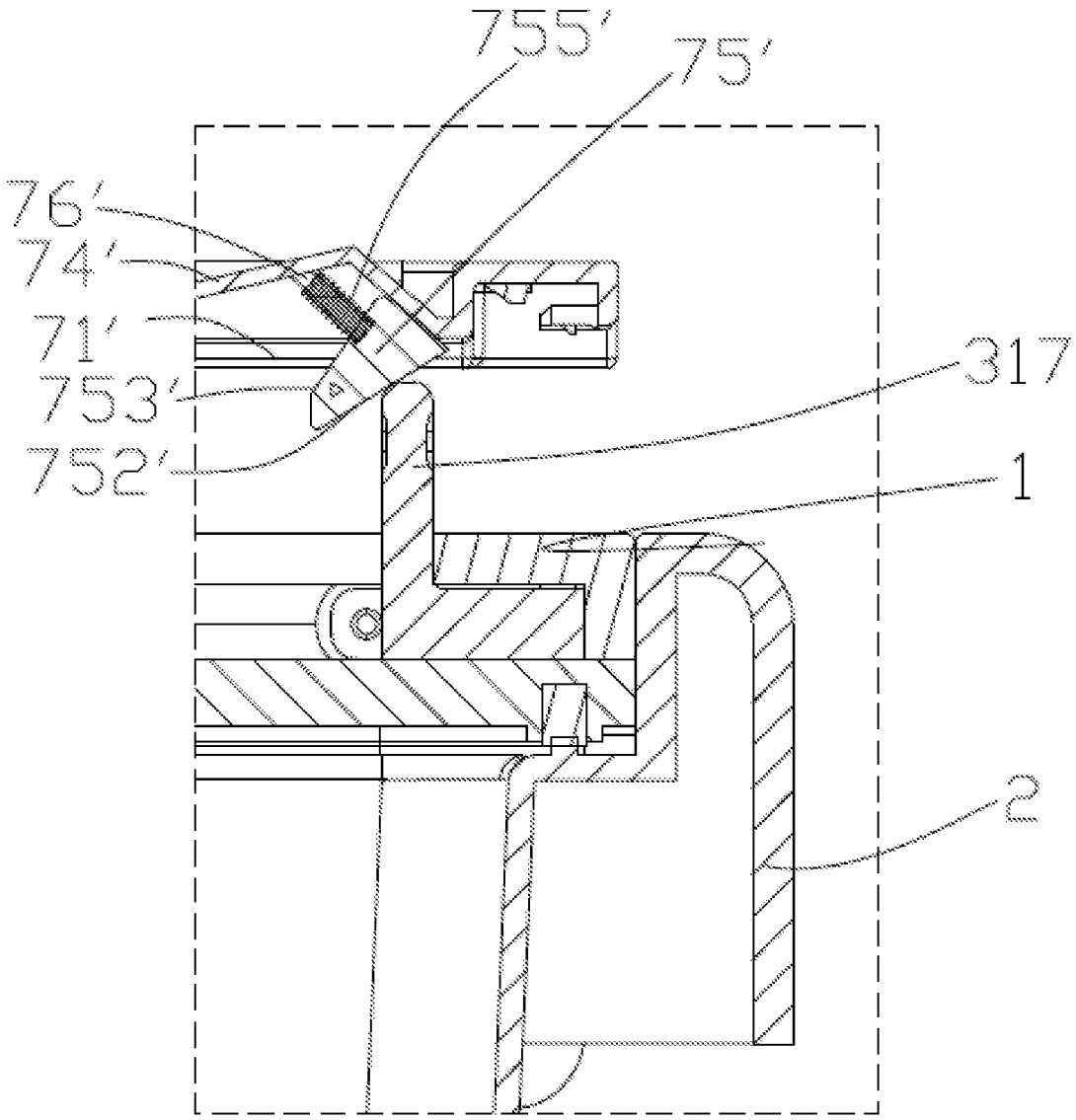
FIG. 17 is local enlarged view of FIG. 16.
Figure 18:
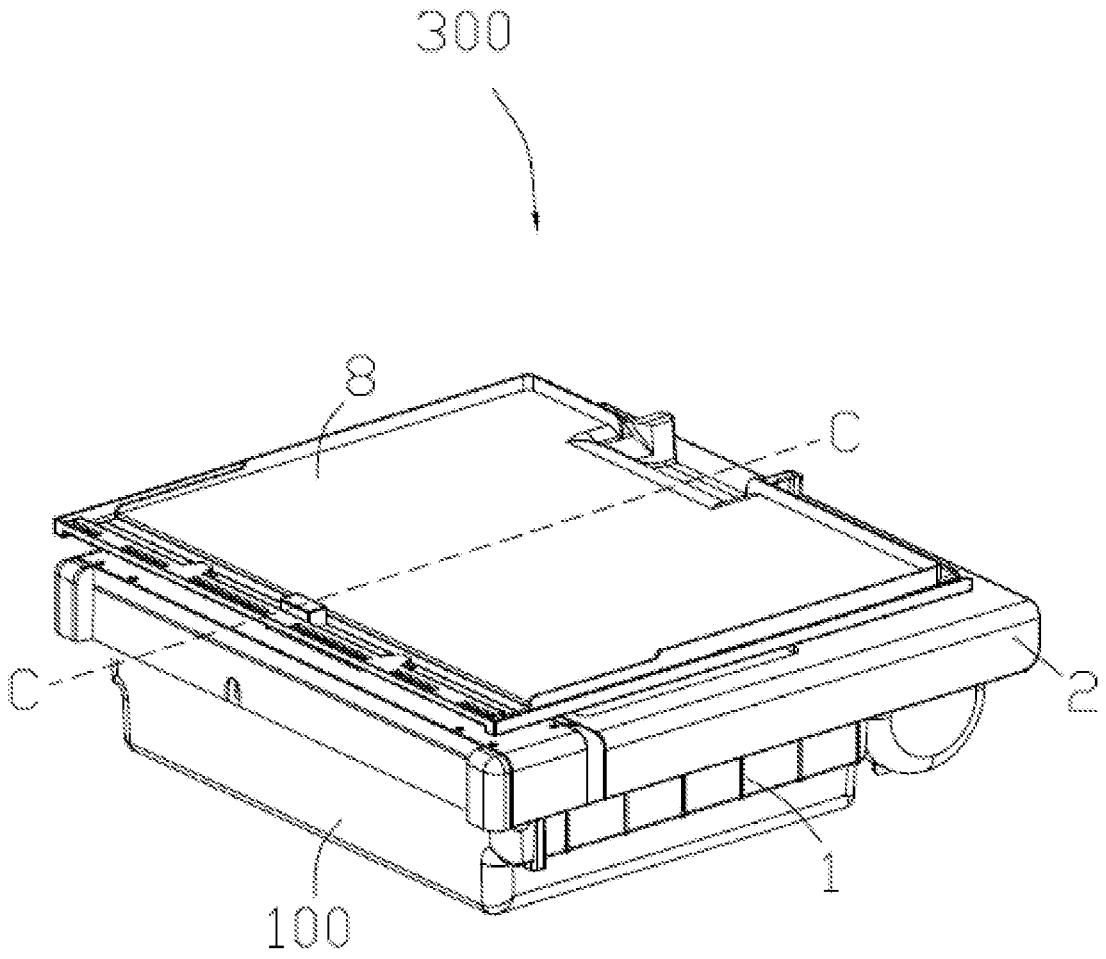
FIG. 18 is a schematic view of an airtight box assembly of the third embodiment of the present invention.
Figure 19:
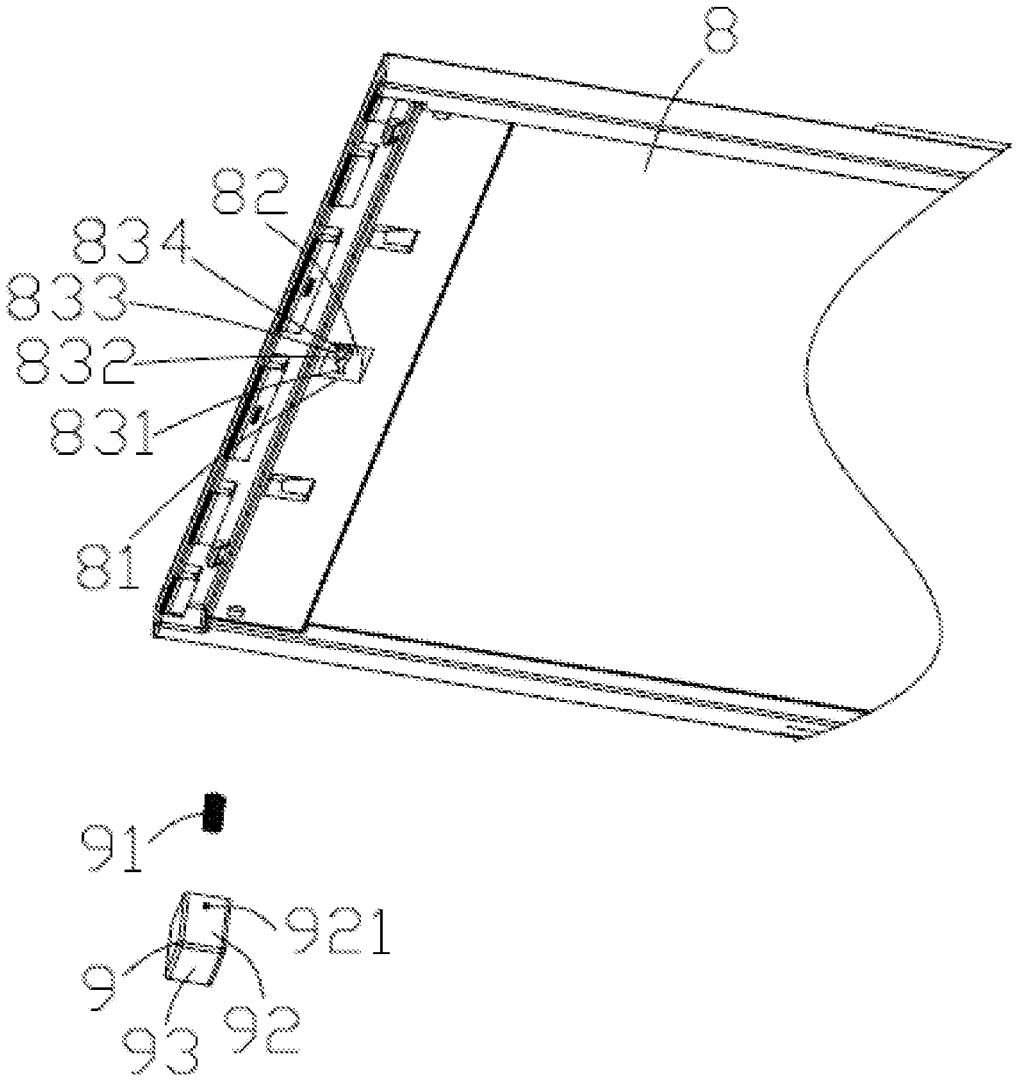
FIG. 19 is a decomposition schematic view of partitioning panels and stopping member of an airtight box assembly of the third embodiment of the present invention.

FIGS. 11-13 respectively show the airtight box assembly 200 in the first embodiment. The partitioning panel 7 is a flat panel, and is arranged above the cover 2 of the airtight box 100 in a parallel manner. At a portion of the partitioning panel 7 close to the pushing hand portion 317 is provided with a vertical through opening 71, two wall bodies 72 respectively extending vertically upwards from the two sides of the opening 71, two installation holes 73 respectively passing through the two wall bodies 72, and a second inclined wall 74 extending upwards and backwards in an inclined manner from the partitioning panel 7 and horizontally connecting the two wall bodies 72. The installation holes 73 are located above the partitioning panel 7. Between the second inclined wall 74 and the two wall bodies 72 is formed a give-way position 70.

The partitioning panel 7 further comprises a stopping member 75. The stopping member 75 includes two installation walls 751 extending vertically at both sides, a first inclined wall 752 located at the front sides of the installation walls 751 and horizontally connecting the installation walls 751, a rear wall 753 located at the rear sides of the two installation walls 751 and connecting the installation walls 751, and installation columns 754 respectively protruding vertically and outwards from the outer sides of the installation walls 751. The installation column 754 is installed in the installation hole 73. The stopping member 75 can rotate upwards or downwards in the opening 71 around the axis of the installation column 754, and can be received in the give-way position 70 between the second inclined wall 74 and the wall body 72. The top of the installation wall 751 further includes a boss 7511, which protrudes outwards, is located above the opening 71 and is supported by the top surface of the partitioning panel 7, so that the stopping member 75 is positioned within the opening 71 and will not be released downwards therefrom. The outer side of the first inclined wall 752 is a first stopping surface which extends from the front to the back and upwards. The outer side of the rear wall 753 is a second stopping surface which extends vertically. The installation column 754 is further fitted over by a spring 755, whose both ends are provided with a first elastic arm 7551 and a second elastic arm 7552 stretching downwards or upwards respectively. In the present embodiment, the spring 755 operates as a torsion spring.

When the refrigerator drawer 900 is in the closed state, the stopping member 75 of the partitioning panel 7 is located at the rear side of the pushing hand portion 317. The first stopping surface of the first inclined wall 751 faces the pushing hand portion 317. If the refrigerator drawer 900 is slightly pushed backwards, the pushing hand portion 317 presses the first stopping surface, and the stopping member 75 is pushed upwards. The stopping member 75 rotates around the installation column 754 until the stopping member 75 contracts upwards till the give-way position 70 above the opening 71. At this time, the first elastic arm 7551 presses the first inclined wall 751, and the second elastic arm 7552 presses the second inclined wall 74. When the pushing hand portion 317 passes the stopping member 75, the stopping member 75 returns to its original position downwards under the action of its self weight and the pushing of the first and second elastic arms 7551, 7552, and is supported by the top surface of the partitioning panel 7. At this time, the second stopping surface is positioned in front of the pushing hand portion 317. When the consumer needs to open the airtight box 100, he/she only needs to pull out the refrigerator drawer 900. The stopping member 75 pushes the pushing hand portion 317 so that the cover 2 and the partitioning panel 7 are maintained to be still relative to each other. The box body 1 of the refrigerator drawer 900 is pulled out, and then the refrigerator drawer 900 is opened. When it needs to clean the cover 2, it only needs to push the stopping member 75 upwards, so that the stopping member 75 contracts upwards to the give-way position 70. Then, the cover 2 can be pulled out.

To sum up, in the refrigerator drawer 900, the partitioning panel 7 is provided between the airtight box 100 and the inner tank of the refrigerator to form the airtight box assembly 200. At a portion of the partitioning panel 7 corresponding to the pushing hand portion 317 is provided the stopping member 75 which can contract upwards or downwards. When the pushing hand portion 317 presses the first stopping surface 752 of the stopping member 75, the stopping member 75 contracts upwards. In this way, the pushing hand portion 317 passes the stopping member 75. Then the stopping member 75 returns to its original position downwards under the action of its self weight and the spring, so that the second stopping surface 753 of the stopping member 75 is positioned in front of the pushing hand portion 317 and pushes the same in an opposite direction. Thus, when the airtight box 100 is pulled out of the inner tank of the refrigerator, the box body 1 is pulled out, and the cover 2 is pushed by the stopping member 75 and is still relative to the partitioning panel 7, thereby achieving the purpose of automatically opening the airtight box 100 using the mechanisms of the refrigerator drawer 900 itself.

Refer to the second embodiment of the airtight box assembly 200' shown in FIGS. 14-17. The airtight box assembly 200' in the present embodiment differs from the airtight box assembly 200 shown in FIGS. 11-13 in the structure of the partitioning panel 7'. Therefore, only the partitioning panel 7' is described here. The partitioning panel 7' is a flat panel, and is arranged above the cover 2 of the airtight box 100 in a parallel manner. At a portion of the partitioning panel 7' close to the pushing hand portion 317 is provided with a vertical through opening 71', two installation holes (not marked with reference numerals) respectively located above the opening 71', and a stopping member 75' rotatably installed in the opening 71'. The stopping member 75' includes a first stopping surface 752' extending from the front to the back and downwards, a back surface 753' facing the first stopping surface 752', and installation columns 754' respectively located at both sides of the stopping member 75'. The installation columns 754' are respectively rotatably installed in the installation holes (not marked with reference numerals). The pushing hand portion 317 is located in front of the first stopping surface 752'. The partitioning panel 7' further includes an elastic contracting member 755', which is received in the opening 71' and whose one end is fixed on the back surface 753', and an inclined panel 74', which is located above the opening 71' and extends from the front to the back and downwards to connect the partitioning panel 7'. The other end of the elastic contracting member 755' is fixed on the inclined panel 74', at whose side facing the opening 71' is provided a protruding column 76' protruding towards the opening 71'. The end of the elastic contracting member 755' which is fixed on the inclined panel 74' is fitted over the protruding column 76'. In the present embodiment, the elastic contracting member 755' is a pressing spring, which operates using its own contracting and rebounding. When the pushing hand portion 317 pushes the stopping member 75' backwards and upwards, the stopping member 75' presses the elastic contracting member 755' upwards and enters the opening 71'. When the pushing hand portion 317 passes the free tail end of the stopping member 75', the stopping member 75' returns to its original position downwards. At this time, the pushing hand portion 317 is located at the rear side of the back surface 753'.

To sum up, in the refrigerator drawer 900, the partitioning panel 7' is provided between the airtight box 100 and the inner tank of the refrigerator to form the airtight box assembly 200'. At a portion of the partitioning panel 7' corresponding to the pushing hand portion 317 is provided the stopping member 75' which can contract upwards or downwards. When the pushing hand portion 317' presses the stopping member 75', the pushing hand portion 317 passes the stopping member 75' using the elastic contracting function of the stopping member 75', and is then pushed in the opposition direction by the back surface 753' of the stopping member 75'. Thus, when the airtight box 100 is pulled out of the inner tank of the refrigerator, the pushing hand portion 317 enables the box body 1 of the airtight box 100 to exit outwards relative to the cover 2, thereby opening the airtight box 100. In this way, the airtight box 100 can be automatically opened by cooperating with the partitioning panel 7'.

Figure 20:
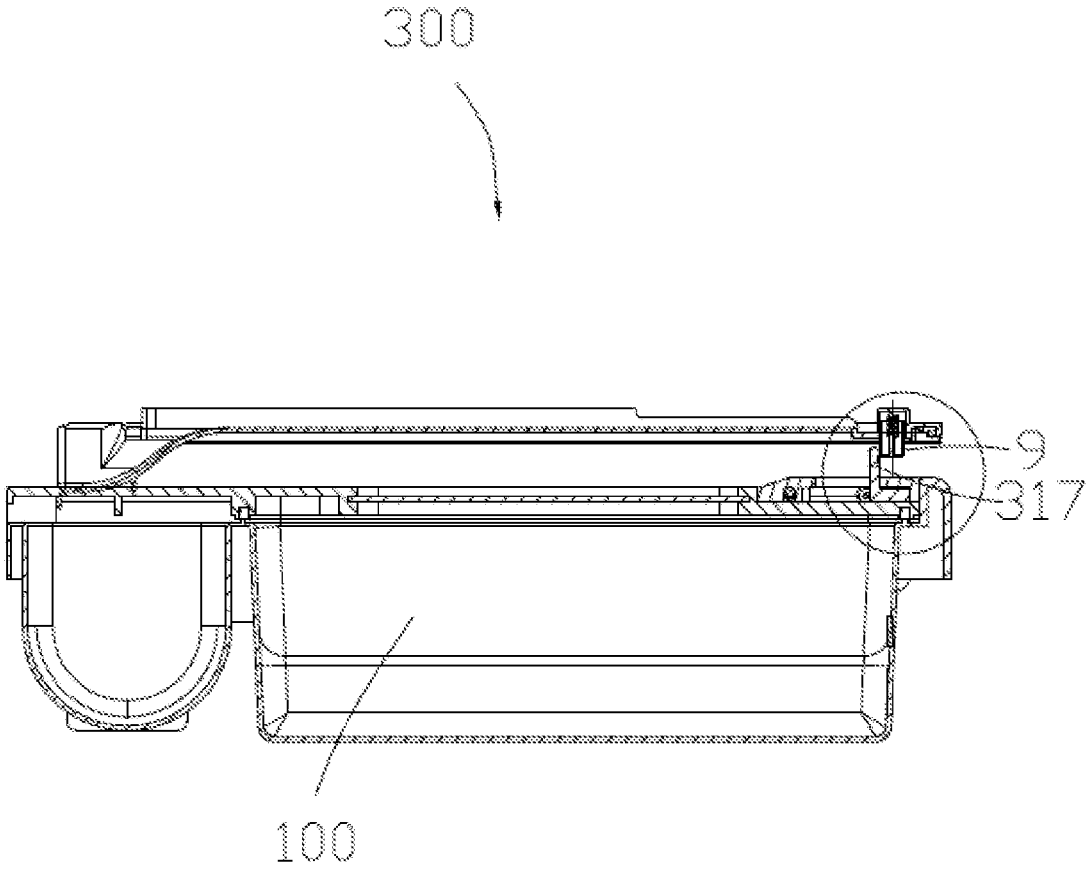
FIG. 20 is a section of an airtight box assembly along C-C of FIG. 18.
Figure 21:
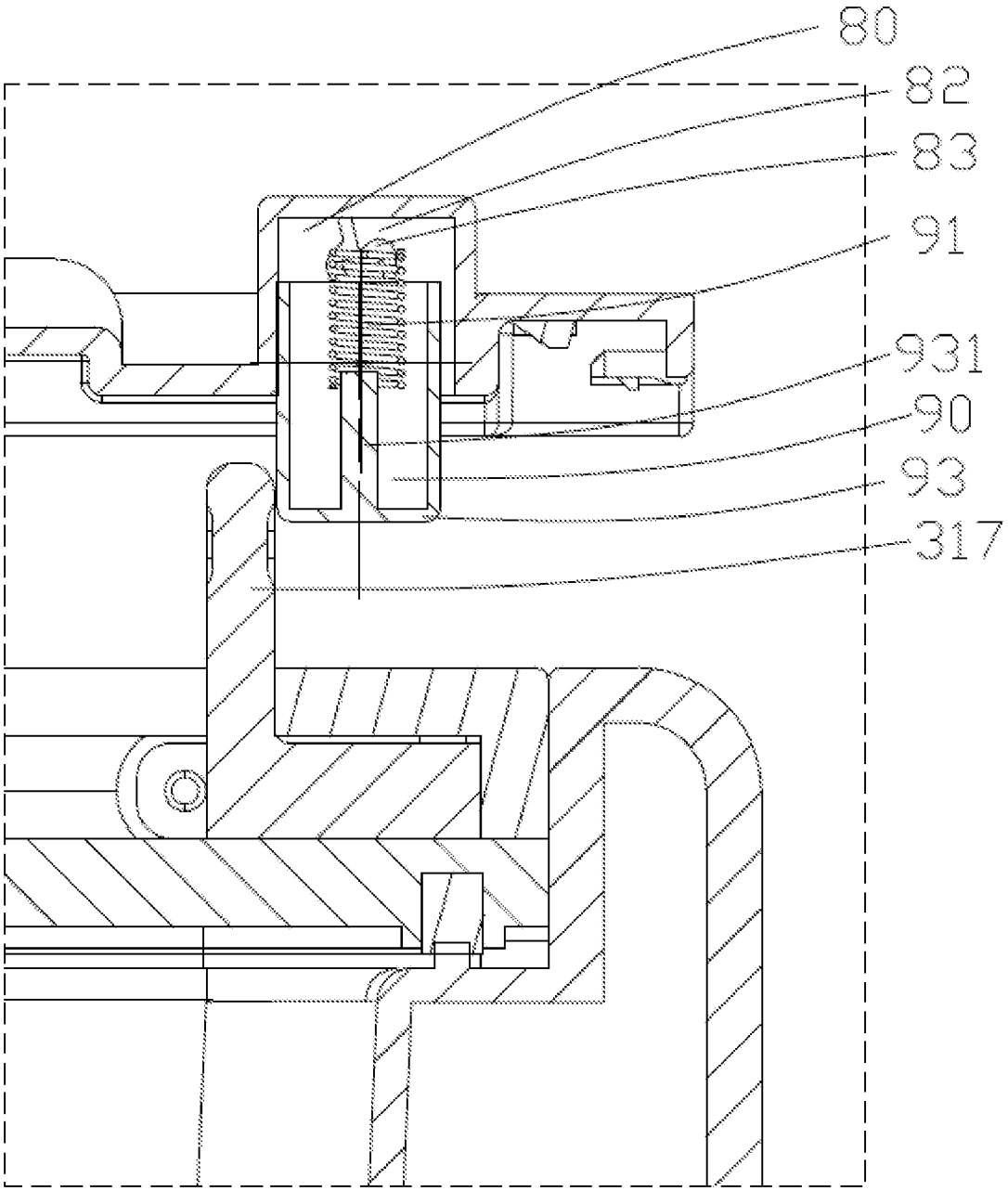
FIG. 21 is a partial decomposition schematic view of an airtight box assembly of the third embodiment of the present invention.

Refer to the third embodiment of the airtight box assembly 300 shown in FIGS. 20-21. The airtight box assembly 300 in the present embodiment differs from the airtight box assemblies 200, 200' shown in FIGS. 11-19 in the structure of the partitioning panel 8. Therefore, only the partitioning panel 8 is described here. The partitioning panel 8 is a flat panel, and is arranged above the cover 2 of the airtight box 100 in a parallel manner. At a portion of the partitioning panel 8 close to the pushing hand portion 317 is provided with a vertical through opening 81, a first cube (not marked with a reference numeral) extending vertically upwards from the periphery of the opening 81, a first receiving chamber 80 located in the first cube, and a stopping member 9 mounted in the first receiving chamber 80 and exposed below the partitioning panel 8.

The first receiving chamber 80 communicates with the opening 81. The first cube includes two first wall bodies 82 respectively extending vertically and located at both sides of the first receiving chamber 80, and two heart-shaped grooves 83 respectively formed by recessing from the inner sides of the two first wall bodies 82. The two heart-shaped grooves 83 are in mirror symmetry. Each heart-shaped groove 83 includes a first positioning portion 831 located at the bottom, a first guiding groove 832 extending from the first positioning portion 831 backwards and then upwards, a second guiding groove 833 extending from the first positioning portion 831 forwards and then upwards, and a second positioning portion 834 located at a junction of the top portions of the first and second guiding grooves 832, 833. The second positioning portion 834 is located at the junction at the top portion of the heart shape of the heart-shaped groove 83.

The stopping member 9 includes a second cube (not marked with a reference numeral) corresponding to the first cube, a second receiving chamber 90 located in the second cube, and a spring 91 installed in the second receiving chamber 90. The second cube is a smaller version of the first cube so as to be able to be received in the first receiving chamber 80 of the first cube. The second cube includes two second wall bodies 92 corresponding to the two first wall bodies 82, and a bottom wall 93 located at the bottom of the second cube for horizontally connecting the two second wall bodies 92. Each second wall body 92 includes a rotary shaft 921 mounted in the heart-shaped groove 83 and protruding outwards. At a side of the bottom wall 93 facing the second receiving chamber 90 is provided with a column 931 protruding upwards for positioning the spring 91.

In the present embodiment, when the refrigerator drawer 900 is in the inner tank of the refrigerator and is in the closed state, the stopping member 9 is located at the rear side of the pushing hand portion 317. The rotary shaft 921 of the second cube is received in the first positioning portion 831 of the heart-shaped groove 83, and the spring 91 is in a relaxed state along a vertical direction. If the user needs to pull out the refrigerator drawer and open the airtight box 100, he/she first needs to slightly push the refrigerator drawer 900 backwards, until the top of the pushing hand portion 317 presses the lower end of the stopping member 9. At this time, the second cube moves upwards under the action of the pushing force. The rotary shaft 921 is driven by the first guiding groove 832 of the heart-shaped groove 83 to slide backwards and upwards from the first positioning portion 831 till the rotary shaft 921 slides into the second positioning portion 834. The second cube is received in the first receiving chamber 80 of the first cube. At this time, the pushing hand portion 317 passes the original position of the stopping member 9 and continues to move backwards. Then, an external force continues pressing the bottom wall 93 of the stopping member 9 upwards. The rotary shaft 921 continues to slide forwards and downwards along the second guiding groove 833 from the second positioning portion 834, and returns to first positioning portion 831. The stopping member 9, pushed by the spring 91, moves downwards from the opening 81 to exceed the partitioning panel 8 to return to its original position, so that the pushing hand portion 317 is located at the rear side of the stopping member 9 (please refer to FIG. 20). In this way, the stopping member 9 forms a block to the pushing hand portion 317. When the user pulls out the airtight box 100, the cover 2 is blocked by the stopping member 9 and does not move, but the box body 1 slides outwards, thereby opening the refrigerator drawer 900 and the airtight box 100.

The airtight box assembly 300 in the present embodiment differs from the airtight box assemblies 200 and 200' of the first and second embodiments in the followings. After the stopping member 9 in the present embodiment is positioned in the second positioning portion 834, an external force is needed to push the stopping member 9 downwards so as to return to its original position. If no external force is present to press the stopping member 9, the airtight box 100 will be opened mechanically. After an external force presses the stopping member, the airtight box 100 can be opened automatically.

To sum up, in the refrigerator drawer 900, the partitioning panel 8 is provided between the airtight box 100 and the inner tank of the refrigerator to form the airtight box assembly 300. At a portion of the partitioning panel 8 corresponding to the pushing hand portion 317 is provided the stopping member 9 which can contract upwards or downwards. When the pushing hand portion 317 presses the stopping member 9, the stopping member 9 operably contracts upwards and returns to its original position downwards. In this way, the pushing hand portion 317 passes the stopping member 9 and is pushed by the same in an opposite direction. Thus, when the airtight box 100 is pulled out of the inner tank of the refrigerator, the box body 1 of the airtight box 100 exits outwards relative to the cover 2 by blocking the pushing hand portion 317 with the stopping member 9, thereby achieving the purpose of opening the airtight box 100. In this way, the airtight box 100 can be automatically opened by cooperating with the partitioning panel 8.

The above embodiments only intend to illustrate the technical solutions of the present invention rather than limit the same. Understanding of the present description should be based on the knowledge of those skilled in the art. For example, the term "longitudinally through" means that a space is through before other parts are installed. For example, the present invention description describes the following terms regarding the directions: "front", "rear", "left", "right", "above/upward", and "below/downward". Although the present description describes the present invention through the above embodiments, equivalent substitutions or modifications of the present invention may be made by those skilled in the art. All the technical solutions and their improvements within the spirit and scope of the present invention shall be embraced by the protection scope of the claims of the present invention.

What is claimed is:

1. An airtight box, comprising a box body and a cover covering the box body to close the box body tightly, wherein the box body is provided with a receiving chamber with an opening which opens upwards and two side walls respectively located on both sides of the receiving chamber, and a sliding groove extending longitudinally is provided on an outer side of each side wall; wherein the airtight box is further provided with an opening and locking mechanism slidably connecting the cover and the box body, wherein the opening and locking mechanism is provided with a pushing member slidably fixed in the sliding grooves of the two side walls respectively and a connecting rod rotatably fixed on the pushing member and mounted inside the cover, and the connecting rod, under an action of the pushing member, presses upwards and drives the cover backwards to expose the receiving chamber to the outside; wherein the pushing member is provided with a main body located above one end of the box body, and two hanging walls extending downwards from both ends of the main body respectively, wherein the main body is provided with a pushing hand portion protruding upwards, and the pushing hand portion passes through the cover upwards and is exposed to the outside.

2. The airtight box of claim 1, wherein the connecting rod is provided with a supporting rod received inside the cover and two ear rods vertically extending from both ends of the supporting rod respectively, wherein each ear rod is mounted on the hanging wall, and when the pushing member moves backwards, the hanging walls pushes the ear rods backwards and the ear rods drive the supporting rod upwards to support the cover upwards.

3. The airtight box of claim 2, wherein each hanging wall is provided with an inverted L-shaped guide rail groove and a position limiting groove, wherein the position limiting groove vertically extends and passes through the hanging wall, and the guide rail groove longitudinally extends and passes through the hanging wall.

4. The airtight box of claim 3, wherein the top of the position limiting groove communicates with the front end of the guide rail groove.

5. The airtight box of claim 4, wherein the opening and locking mechanism further comprises a sliding member capable of sliding in each sliding groove longitudinally, wherein the sliding member is provided with a first pulley mounted in the position limiting groove and a second pulley mounted in the guide rail groove, and the second pulley is capable of rotating counterclockwise around the first pulley.

6. The airtight box of claim 5, wherein the first pulley is provided with a front orienteering roller capable of sliding in the each sliding groove, a fixed wheel located at an outer side of the front orienteering roller, and a first shaft passing through the axes of the front orienteering roller and of the fixed wheel, wherein an intermediate space is provided between the front orienteering roller and the fixed wheel to form a clamping portion.

7. The airtight box of claim 5, wherein the second pulley is provided with a driven roller and a shaft cavity passing through the driven roller, wherein an edge of the driven roller is clamped within the clamping portion, and a tail end of the ear rod is received within the shaft cavity.

8. The airtight box of claim 2, wherein the cover is provided with a box cover and a top cover mounted on the box cover, wherein a position limiting space is provided between the top cover and the box cover to allow the supporting rod to move upwards or downwards.

9. The airtight box of claim 8, wherein a side of the box cover facing the top cover is provided with several fixing columns protruding upwards and arranged longitudinally to longitudinally limit the supporting rod in the position limiting space.

* * * * *